United States Patent [19]

Lancaster, III et al.

[11] 4,050,221

[45] Sept. 27, 1977

[54] STRETCH-WRAPPED PACKAGE, PROCESS AND APPARATUS

[75] Inventors: Patrick R. Lancaster, III; William G. Lancaster, both of Louisville, Ky.

[73] Assignee: Lantech, Inc., Louisville, Ky.

[21] Appl. No.: 493,050

[22] Filed: July 30, 1974

Related U.S. Application Data

[62] Division of Ser. No. 347,873, April 4, 1973, Pat. No. 3,867,806.

[51] Int. Cl.[2] ..... B65B 11/04

[52] U.S. Cl. ..... 53/211; 53/184 R

[58] Field of Search ..... 53/27, 305, 30 R, 184 S, 53/184 R, 211, 212, 214; 242/75.43, 75.2; 188/166

[56] References Cited

U.S. PATENT DOCUMENTS

| | | | |
|---|---|---|---|
| 1,329,311 | 1/1920 | Roberts | 53/30 X |
| 1,380,837 | 6/1921 | Replogle | 242/75.2 |
| 1,806,683 | 5/1931 | Roberts | 188/166 |
| 1,959,878 | 5/1934 | Schroeder | 188/166 X |
| 2,423,294 | 7/1947 | Colesworthy | 53/30 X |
| 2,545,243 | 3/1951 | Rumsey, Jr. | 53/184 X |
| 2,592,091 | 4/1952 | Weaver | 188/166 X |
| 2,770,284 | 11/1956 | Myrick | 242/7.22 X |
| 2,914,893 | 12/1959 | Berst | 53/184 X |
| 3,116,032 | 12/1963 | Roberts | 242/75.43 |
| 3,213,975 | 10/1965 | Edwards | 188/166 X |
| 3,238,558 | 3/1966 | Greene | 188/166 X |
| 3,419,228 | 12/1968 | Harless | 242/75.43 |
| 3,495,375 | 2/1970 | Burhop | 53/33 |
| 3,514,920 | 6/1970 | Hoffler | 53/184 X |
| 3,589,091 | 6/1971 | Cloud | 53/184 X |
| 3,596,434 | 8/1971 | Zelnick | 53/182 X |
| 3,640,048 | 2/1972 | Zelnick | 53/30 |
| 3,685,233 | 8/1972 | Lassig | 53/33 |

*Primary Examiner*—Othell M. Simpson
*Assistant Examiner*—John Sipos
*Attorney, Agent, or Firm*—Gipple & Hale

[57] ABSTRACT

This invention provides a process for making a unitary package which comprises a load that has a band formed of plural layers of a stretched material wrapped around it. Basically the process comprises the steps of: placing a load on a support; locating a rolled-up sheet of stretchable material on dispenser means adjacent to the support; withdrawing a leading edge of the material from the dispenser means and holding that leading edge against the load; initiating substantially unrestricted relative movement between the support and dispenser means to cause a sufficient amount of the material to overwrap at least a part of the load; subsequently continuing the relative movement but restricting it such that the material will then be stretched and causing a sufficient amount of the stretched material to be dispensed from the dispenser means to provide a band comprising plural layers of the material around the load; and fastening the trailing edge of the dispensed stretched material to at least one of the previously dispensed band-forming layers. The present invention is also directed toward a product that is produced by this process and to certain apparatus which can be utilized to perform this process.

5 Claims, 9 Drawing Figures

STRETCH-WRAPPED PACKAGE, PROCESS AND APPARATUS

This is a division of application Ser. No. 347,873, filed Apr. 4, 1973, now U.S. Pat. No. 3,867,806.

BACKGROUND OF THE INVENTION

This invention relates to packaging and, more particularly, to a process for making a unitary package which comprises a load that has a band formed of plural layers of a stretched material wrapped around it. The present invention is also concerned with the product produced by such a process and to certain apparatus which can be utilized to perform the process.

In the past, various methods and apparatus have been utilized to provide a unitary package comprising a load having at least a portion of its surface overwrapped by a heat-shrunk material. Such methods are commonly referred to as "shrink-palletizing" processes and basically comprise unitization of a palletized package load by first overwrapping it with a heat shrinkable material which is then tightly shrunk against the package load by applying sufficient heat to the overwrapped load to raise its temperature to the heat-shrinking temperature of the overwrapping material. Our U.S. Pat. No. 3,793,798, describes a recent and efficient form of such "shrink-palletizing" systems; while older forms thereof have been described in detail in U.S. Pat. Nos. 3,514,920; 3,581,458; 3,590,549; 3,626,654; 3,640,048; 3,662,512; and 3,670,880.

While the aforedescribed "shrink-palletizing" systems have produced a product which has been generally satisfactory, they require heating means and, if a portion of the overwrapped package load is removed after completion of the heating step, the remaining portions tend to become loosened since the overwrapping material becomes permanently set and loses its elasticity after the heating has been performed.

Previous attempts have been made to overcome these disadvantages of the "shrink-palletizing" systems by substituting non-heated overwrapping systems, such as that described in U.S. Pat. No. 3,495,375 and another marketed by Arenco Machine Company, Inc., of Teterboro, N.J. Such non-heated systems are commonly known as "stretch-palletizing" systems, wherein the package load is overwrapped by a single-layer band of stretchable material that is held in tension around the package load but not heat-shrunk to it. Although the cost of the heating means and step and the problems of loss of elasticity and load loosening which exist in the "shrink-palletizing" systems, have been eliminated these prior-art single-layer band "stretch-palletizing" systems have several disadvantages of their own. For one example, the trailing edge or edges of the band-forming overwrapping material must be fin-sealed (as opposed to lap-sealed) along substantially their entire width and this requires elaborate clamping and sealing means. For another, tension is not evenly applied to the material forming the overwrapping band. And, for yet another, the sharp edges of the surface of the overwrapped package load tend to pierce the single layer of the tensioned wrapper band as it is dispensed therearound.

The present invention is particularly concerned with providing an improved process for producing a unitary package, which is somewhat similar to the aforenoted single-layer "stretch-palletizing" systems in that it provides similar advantages over the aforedescribed "shrink-palletizing" systems, but which also eliminates the aforenoted problems which have heretofore plagued the earlier forms of "stretch-palletizing" systems.

SUMMARY OF THE INVENTION

The present invention provides a process for making a unitary package which comprises a load that has a band formed of plural layers of a stretched material wrapped around it.

Basically the process comprises the steps of: placing a load on a support; locating a rolled-up sheet of stretchable material on dispenser means adjacent to the support; withdrawing a leading edge of the material from the dispenser means and holding that leading edge against the load; initiating substantially unrestricted relative movement between the support and dispenser means to cause a sufficient amount of the material to overwrap at least a part of the load; subsequently continuing the relative movement but restricting it such that the material will then be stretched and causing a sufficient amount of the stretched material to be dispensed from the dispenser means to provide a band comprising plural layers of the material around the load; and fastening the trailing edge of the dispensed stretched material to at least one of the previously dispensed band-forming layers.

The present invention is also directed toward a product that is produced by this process and to certain apparatus which can be utilized to perform this process.

BRIEF DESCRIPTION OF THE DRAWINGS

The present invention is illustrated in the accompanying drawings wherein.

DETAILED DESCRIPTION

Figure 1:
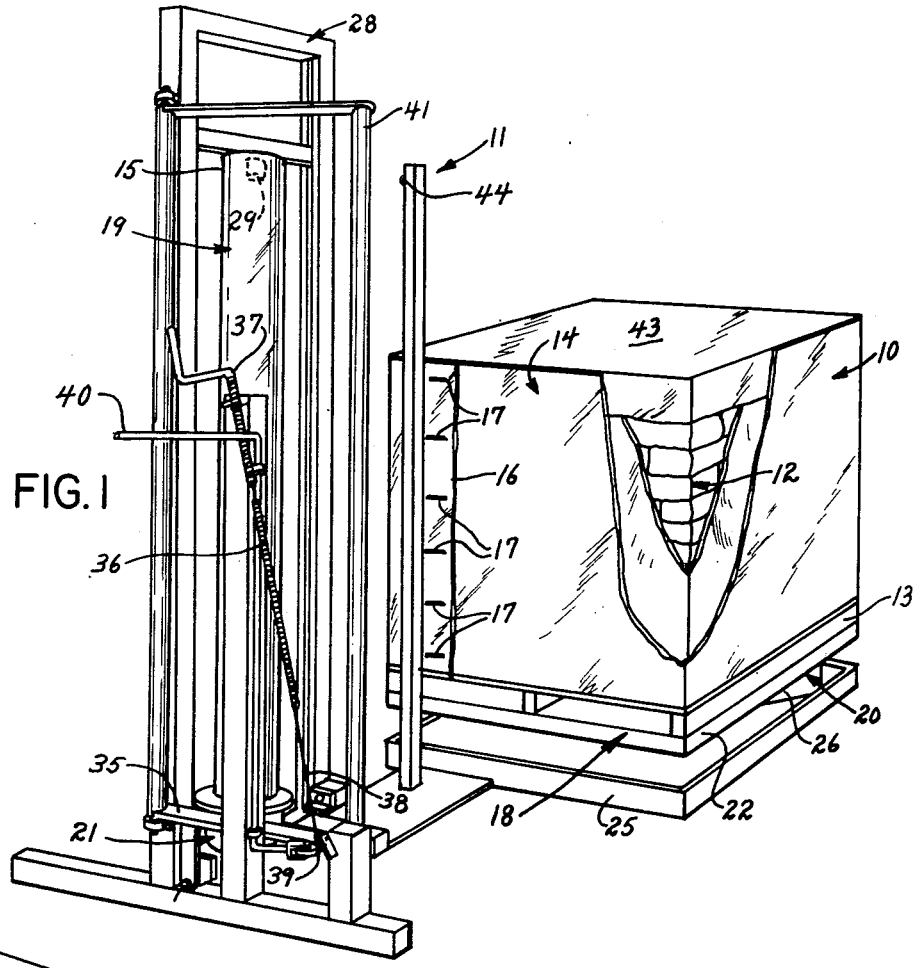
FIG. 1 is a somewhat schematic partly broken elevational perspective view showing a presently preferred form of apparatus that can be utilized in performing the novel process of the present invention to produce its novel unitary package, which comprises a load that has a band formed of plural layers of a stretched material wrapped around it, and illustrates the apparatus just following completion of the process.
Figure 2:
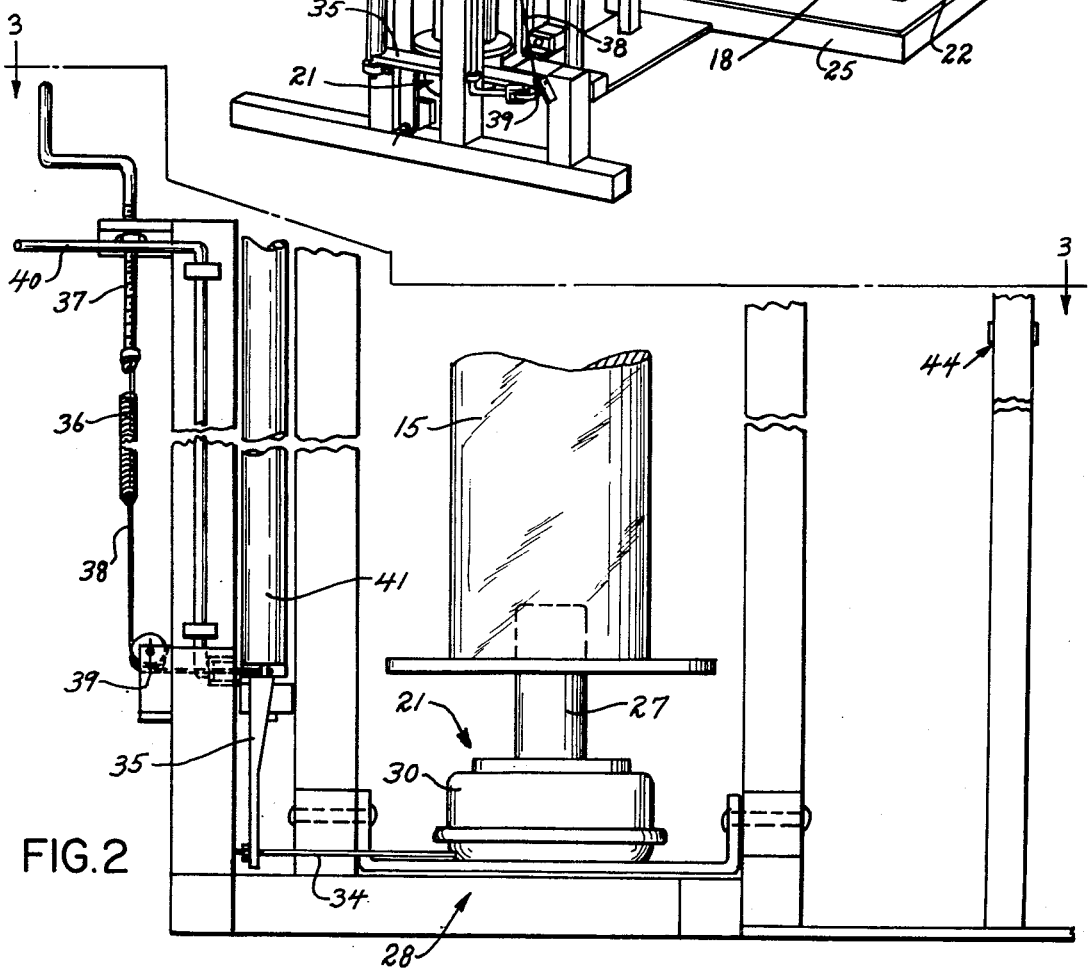
FIG. 2 is a greatly enlarged fragmentary elevational view showing in detail the construction of the presently preferred forms of the overwrapping film dispenser means, restricting means for causing stretching of the dispensed film, control means for selectively adjusting the restricting means and cutter means for severing the dispensed material from the dispenser means of the apparatus shown in FIG. 1.

Referring now to the drawings and more particularly to FIG. 1 thereof, there is illustrated, with parts broken away for purposes of illustration, a typical product, a unitary package 10, which can be produced in accordance with the novel process that is provided in accordance with the present invention. While it should be understood that various means could be employed, FIGS. 1-9 of the drawings illustrate a form of apparatus 11 that has been used with good results in carrying out the novel process of the present invention to produce the product 10.

As further shown in FIG. 1, the product 10 comprises a palletized load of plural boxes 12 built upon a skid 13 and has its generally vertically arranged portion overwrapped by a band 14 formed of plural layers of a stretched sheet of stretchable material 15 wherein the trailing edge 16 of the stretched material 15 is fastened to at least one of the previously wrapped band-forming layers of the material 15. Preferably, the material 15 is of a type that is heat laminateable and this fastening is performed by heat sealing means 17*a* (FIG. 6) which provides a plurality of fastening heat seals 17 that are aligned at an angle with respect to the trailing edge 16 of the sheet of material 15 and are spaced apart from one another.

Figure 3:
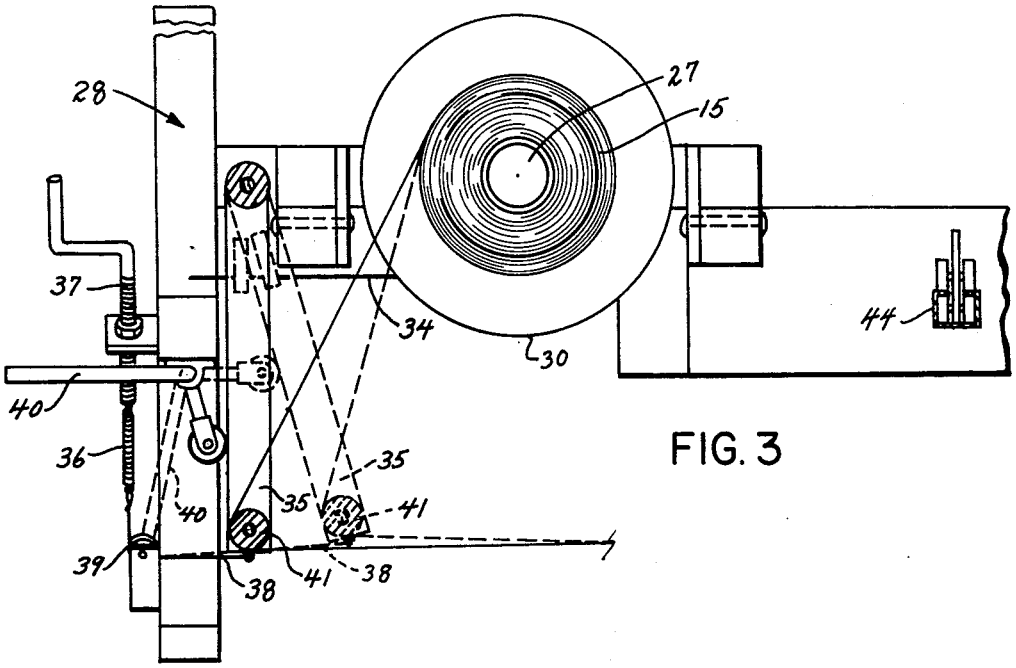
FIG. 3 is a fragmentary sectional view taken along line 3—3 of FIG. 2.
Figure 4:
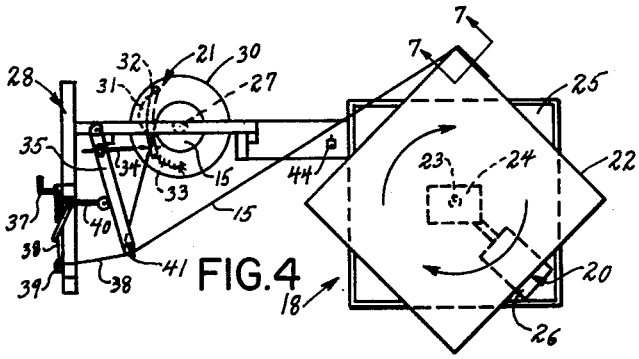
FIG. 4 is a schematic top plan view of the apparatus of FIG. 1 illustrating it in a first condition of operation.
Figure 7:
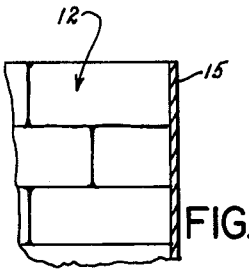
FIG. 7 is a greatly enlarged fragmentary sectional view taken along line 7—7 of FIG. 4.
Figure 5:
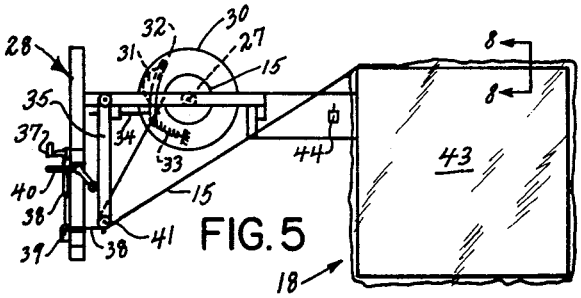
FIG. 5 is a view similar to that shown in FIG. 4, but showing the apparatus in another condition of operation.
Figure 8:
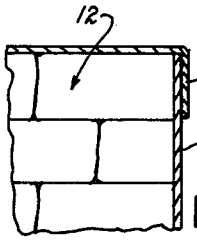
FIG. 8 is a greatly enlarged fragmentary sectional view taken along line 8—8 of FIG. 5.
Figure 6:
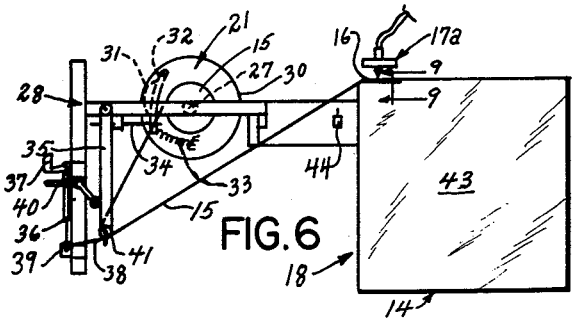
FIG. 6 is a view similar to that shown in FIGS. 4 and 5, but showing the apparatus in yet another condition of operation.
Figure 9:
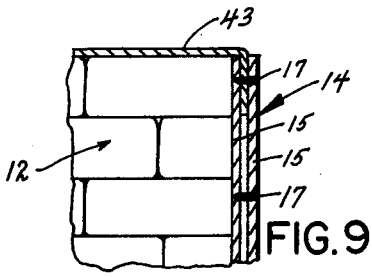
FIG. 9 is a greatly enlarged fragmentary sectional view taken along line 9—9 of FIG. 6.

As illustrated in FIGS. 1-9, the presently preferred form of apparatus 11 that can be employed to perform the process of the present invention to produce the product 10 basically includes a support means 18 for supporting the package load 12; dispenser means 19 for locating a rolled-up sheet of the material 15 for movement relative to the support means 18; drive means 20 for initiating substantially unrestricted relative movement between the support 18 and dispenser means 19 to cause a sufficient amount of the material 15 to be dispensed from the dispenser means 19 to overwrap at least a part of the load 12 (FIG. 4); and restricting means 21, such as a brake best shown schematically in FIGS. 4-6 for restricting continuation of the relative movement such that the material 15 wil then be stretched (FIG. 6) but permitting a sufficient amount of the stretched material 15 to be dispensed from the dispenser means 19 to provide the band 14 comprising plural layers of the material 15 around the load 12 (FIGS. 1, 6 and 9).

As best shown in FIGS. 1 and 4, the support means 18 preferably comprises a generally horizontally arranged platform 22 which can support the skid 13 for rotary movement about a generally vertically arranged axis. As schematically illustrated in FIG. 4, the platform 22 is supported on a vertical axle 23 journaled in a bearing 24 centrally located in a base 25 for the support means 18 and is suitably interconnected to the drive means 20, which can comprise a rotary electric motor 26 or other suitable means, for substantially unrestricted rotary movement around the generally vertical axis of the axle 23 (in a clockwise direction as viewed in FIGS. 4-6).

And, as best illustrated in FIGS. 1-6, the dispenser means 19 comprises a generally vertically arranged member of shaft 27 that is mounted on a base frame 28 located adjacent to the support means 18 for substantially unrestricted rotary movement relative thereto about a generally vertical axis. The upper end of this shaft 27 removably receives the lower end of and generally vertically supports a rolled-up sheet of the stretchable material 15, while the upper end of the rolled-up sheet is rotatably journaled by an upper journal member 29 which is mounted for slidable vertical movement relative to the base frame 28. This illustrated construction provides the dispenser means 19 with height adjustable means for mounting overwrapping material of various widths to thus accommodate overwrapping of package loads 12 of various heights.

While it should be understood that various other substantially equivalent means could be substituted, such as clutch means, etc., the presently preferred form of the restricting means 21 that are employed in the apparatus 11 comprise brake means which are provided adjacent the lower end of the dispenser means rotary shaft 27. As best shown in FIGS. 4-6, these illustrated restricting means 21 comprise a brake drum 30 which is fixed on the lower end of the dispenser means shaft 27 for rotation therewith and that can be engaged and disengaged by a brake shoe 31 which is carried by a brake lever 32 that is pivotally mounted to the dispenser means frame 28. As shown, the brake shoe 31 that is carried by the lever 32 is yieldably urged out of engagement with the brake drum 30 by a first tension spring 33 (FIG. 4) to thus permit substantially unrestricted rotary movement of the dispenser means shaft 27. However, the yieldably urging of this first spring 33 can be overcome and the brake lever 32 can be pivoted to engage the brake shoe 31 carried by it with the brake drum 30 through movement of a cable 34 which has one of its ends connected to the pivoted brake lever 32. The brake cable 34 has its other end connected to a brake operating arm 35 that is pivotally mounted with respect to the dispenser means frame 28. The brake cable operating arm 35 is, in turn, yieldably urged by a second tension spring 36 in a direction causing the brake cable 34 to move the brake lever 32 with sufficient force to overcome the urging of the first spring 33 and thus cause engagement of the lever-carried brake shoe 31 with the brake drum 30.

As further shown, this second tension spring 36 is connected between the dispenser frame 28 and the brake cable operating arm 35 by adjustable control means, such as the illustrated jack screw 37 and wire 38 and pulley 39 arrangement, whereby the brake engaging counter-force which it provides with respect to the brake disengaging force of the first spring 33 can be readily adjusted. As further illustrated, a brake release device 40 is also pivotally mounted to the dispenser frame 28 which can be releasably engaged with the brake cable operating arm 35 to completely overcome the counter force of the second spring 36 and allow the first spring 33 to fully release the lever-carried brake shoe 32 from engagement with the brake drum 30 (FIG. 4).

However, it should be understood that barring engagement of the brake release device 40 with the brake cable operating arm 35, as shown in FIG. 4, or the exertion of some other releasing force thereupon, the second spring 36 will exert sufficient force to overcome that provided by the first spring 33 and the brake shoe 32 and drum 30 will remain engaged and movement of the dispenser roller shaft 27 will consequently be so restricted, as shown in FIGS. 5 and 6.

In particular accordance with the present invention, the brake cable operating arm 35 rotatably journals a generally vertically arranged roller 41 over which the leading edge of the rolled-up sheet of material 15 can be first threaded prior to its engagement with the package load 12 at the commencement of the process of the present invention. During the initial part of the process of the present invention, the brake or restricting means release device 40 is preferably engaged with the brake cable operating arm 35 as shown in FIG. 4, to thus permit substantially unrestricted relative movement between the support 18 and dispenser 19 means upon energization of the drive means 20. However, once a portion of the package load 12 has been overwrapped, the brake release device 40 is pivoted, as shown in FIG. 5, out of engagement with the brake cable operating arm 35 and continued operation of the drive means 20 will cause relative movement between the support 18 and dispenser 19 means only when the pull of the drive means 20 as exerted through the portion of the dispensed sheet 15 passing over the brake cable operating arm roller 41 is sufficient to partially overcome the counter-force of the second spring 36 and thus permit sufficient movement of the wire 38, arm 35, cable 34 and lever 32 to allow the first spring 33 to partially release the brake shoe 31 from engagement with the dispenser shaft-carried brake drum 30. This restriction of relative movement by the restricting means 21 will, of course, cause the dispensed sheet of material 15 to then be stretched.

While it should be understood that various stretchable materials may be employed for the sheet of overwrapping material 15, good results can be obtained in accordance with the present invention by employing a polyethylene film having thickness in a range between 0.00075 and 0.004 inches and a specific gravity in a range from 0.915 through 0.922 which can be stretched in an elongation range of from 2% through 100% under from 600 to 2,000 P.S.I. of force. And, while it should be similarly understood that various forms of equipment can be utilized for the heat-sealing means 17*a* (FIG. 6) to perform the fastening step without departing from the true spirit and scope of the present invention, good results have been obtained by employing an inexpensive commercially available, electrically-powered hand-size heat sealer when the aforedescribed polyethylene film was utilized for the material 15. It should also be understood that this fastening might be accomplished other than by heat sealing, as by use of an adhesive or mechanical means, such as staples and the like, or other forms of fastening means.

Basically, the novel process that is provided in accordance with the present invention comprises the steps of: placing a load on a support; locating a rolled-up sheet of stretchable material on dispenser means adjacent to the support; withdrawing a leading edge of the material from the dispenser means and holding that leading edge against the load; initiating substantially unrestricted relative movement between the support and dispenser means to cause a sufficient amount of the material to overwrap at least a part of the load; subsequently continuing the relative movement but restricting it such that the material will then be stretched and causing a sufficient amount of the stretched material to be dispensed from the dispenser means to provide a band comprising plural layers of the material around the load; and fastening the trailing edge of the dispensed stretched material to at least one of the previously dispensed band-forming layers.

To produce a product, such as the illustrated unitary package 10, by the novel process of the present invention with the illustrated apparatus 11, an operator first mounts a rolled-up sheet of the material 15 having a width sufficient to cover at least the vertical portion of the package load 12 on the shaft 27 and upper journal member 29 of the dispenser means 19.

Next, the operator utilizes a fork-lift truck or other suitable conveyor means to place the package load 12 and its skid 13 atop the platform 22 of the support means 18 to align its center generally over that of the platform axle 23.

Then, the operator moves the brake release device 40 into engagement with the brake cable operating arm 35 as shown in solid lines in FIG. 4 and in shadow lines in FIG. 3 to fully release the restricting means 21 and permit substantially unrestricted rotary movement of the dispenser means shaft 27 and upper journal member 29.

Next, the operator withdraws the leading edge of the rolled-up sheet of the material 15 from the dispenser means 19 and, having first threaded it over the brake cable operating arm roller 41 as shown in solid lines in FIG. 4 and in shadow lines in FIG. 3, holds that leading edge against the vertical surface of the package load 12 either manually or with fastener means (not shown).

Then, the operator energizes the drive means 20 in a well-known manner through closure of switch means (not shown) which cause the drive means motor 26 to initiate rotation of the support means platform 22 and the package load 12 and skid 13 carried by it about the generally vertical axis of the platform shaft 23. This, in turn, causes substantially unrestricted relative movement between the support means 18 and the dispenser means 19 such that a sufficient amount of the rolled-up material 15 will be unwound or dispensed from the dispenser means 19 through the substantially unrestricted rotary movement of the support means platform 22 and the dispenser means shaft 27 and upper journal member 29 to overwrap at least a part of the package load 12. As illustrated, this substantially unrestricted movement is allowed to continue approximately one revolution of the support platform 22 and the package load 12 carried by it whereby a band comprising a single unstretched layer of the material 15 is overwrapped around the generally vertically arranged portion of the package load 12.

Now, as best shown in FIGS. 5 and 8, the operator can with a separate wrapper, such as an overcapping sheet 43, overwrap a portion of the package load 12 (the top of the package load 12 as illustrated) not previously overwrapped by the sheet of material 15.

Next, the operator pivots the brake release device 40 out of engagement with the brake cable operating arm 35, as shown in solid lines in FIGS. 3, 5 and 6, activating the restricting means 21 as previously described above, and continues energization of the drive means 20 and thus provides continuous but now restricted relative movement between the support 18 and dispenser means 19 such that the dispensed sheet material 15 will then be stretched causing a sufficient amount of the stretched material 15 to be dispensed from the dispenser means 19 to provide the band 14 which comprises plural layers, including at least one outer stretched layer, as shown in FIG. 1, of the material 15 around the package load 12.

Then, as best shown in FIGS. 1 and 6, while maintaining the stretching of the dispensed sheet 15 through continued energization of the drive means 20, the operator fastens the trailing edge 16 of the stretched dispenser material 15 in an overlapping seal to at least one of the previously dispensed band-forming layers. As illustrated, this fastening is preferably performed by heat sealing, assuming the material is a heat laminateable material such as polyethylene, and the heat-sealing step is performed manually by the operator with means such as the illustrated heat-sealing device 17*a* to provide the plurality of fastening heat seals 17 that are aligned at an angle (approximately a 90 degree angle) with respect to the width of the trailing edge of the dispensed material sheet 15 and are spaced apart from one another therealong.

Next, upon completion of this fastening step, the operator now severs the overwrapped package from the dispenser means, as by employing the illustrated drop-knife cutter means 44 which is preferably mounted adjacent the support means 19 and finally de-energizes the drive means 20. The novel overwrapped product 10 (FIG. 1) that is produced by the novel process of the present invention can now be removed from the support means platform 22 by a fork-lift or other suitable conveyor means.

The operator can selectively adjust the restrictive effect of the restricting means 21 through operation of the jack screw 37 of the aforedescribed control means to thereby selectively alter the degree of elongation of the stretched dispensed material 15.

It should be apparent that while there has been described what is presently considered to be a presently preferred form of the present invention in accordance with the Patent Statues, changes may be made in the disclosed process and product produced thereby without departing from the true spirit and scope of this invention.

For example, other equivalent forms of apparatus might be substituted for the illustrated apparatus 11. Various materials might be used for the material 15, so long as they are of a type that is stretchable. And, the optional overcapping sheet 43 could be installed either before or after the actuation of the restricting means 21 to cause the stretching of the sheet 15; it being necessary only that such optional installation of the separate overcapping sheet 43 be performed prior to the dispensing of the outermost one of the plural layers of the sheet 15 which form the multi-layered band 14. It is, therefore, intended that the appended claims shall cover such modifications and applications that may not depart from the true spirit and scope of the present invention.

What is claimed is:

1. Apparatus for making a unitary package comprising:

a. support means for supporting a load; said support means comprising a base, shaft means rotatably mounted to said base and platform means secured to said shaft means;

b. dispenser means for holding a rolled-up sheet of a stretchable material positioned adjacent to said support means; said dispenser means comprising a frame a second shaft means rotatably mounted to said frame, said second shaft means being adapted to hold said rolled-up sheet of a stretchable material;

c. drive means connected to said support shaft means for rotating said support means, said drive means being adapted to effect relative movement between said support and dispenser means to cause a sufficient amount of said material to be dispensed from said dispenser means when interconnected by said stretchable material to overwrap said load; and d. brake means connected to said dispenser second shaft means, said brake means being adapted to assume a plurality of positions relative to said second shaft means including a first position spaced away from said second shaft means for effecting substantially unrestricted movement of said material from said dispensing means to said load when said dispensing means is rotated and a second position of engagement with said second shaft means for restricting subsequent continuation of material movement from said dispenser means to said load while said dispenser means is being rotated so that said material will then be stretched permitting a sufficient amount of said stretched material to be dispensed from said dispenser means to provide a band comprising plural layers of said material around said load.

2. Apparatus as claimed in claim 1 wherein said brake means comprises; a brake drum secured to said dispenser shaft and adapted to rotate therewith, brake shoe means moveably mounted to said frame and adapted to engage said brake drum;

first spring means connected to said brake shoe means and placing a force on said brake shoe means to urge said brake shoe means away from said brake drum; and second spring means connected to said brake shoe means adapted to be selectively operated to overcome the force of said first spring means to urge said brake shoe means against said brake drum.

3. Apparatus as claimed in claim 1 including cutter means for severing said material from said dispenser means, said cutter means comprising a cutter bar defining a track mounted to said frame and knife means moveably mounted in said track.

4. Apparatus as claimed in claim 21 including an adjustable material holder comprising an upper journal member mounted to said frame and adapted to selectively accommodate material of various widths.

5. Apparatus for making a unitary package comprising:

a. support means for supporting a load; said support means comprising a base, shaft means rotatably mounted to said base and platform means secured to said shaft means;

b. dispenser means for holding a rolled-up sheet of a stretchable material positioned adjacent to said support means, said dispenser means comprising a frame, a shaft rotatably mounted to said frame, said shaft being adapted to hold said rolled-up sheet of a stretchable material and an adjustable journal mounted to said frame above said shaft;

c. drive means connected to said support shaft for rotating said support means, said drive being adapted to effect relative movement between said support and dispenser means when both are interconnected by said stretchable material to cause a sufficient amount of said material to be dispensed from said dispenser means to overwrap said load; an d. brake means mounted to said dispenser means shaft, said brake means comprising a brake drum, a brake shoe means mounted to said frame and adapted to engage said brake drum, a first spring means connected to said brake shoe means, urging said brake shoe means away from engagement with said brake drum, a second spring means connected to said brake shoe having a force greater than said first spring means, to continuously place said brake shoe in engagement with said brake drum and release means engaging said second spring means, said release means when activated overcoming the force of said second spring means so that said first spring means urges said brake shoe away from said brake drum, said first spring means, second spring means and release means all being operable while said support means is being rotated, said brake means being adapted to assume a plurality of positions relative to said shaft including a first position for effecting substantially unrestricted movement of said material from said dispensing means to said load when said dispensing means is rotated and a second position for restricting subsequent continuation of material movement from said dispensing means to said load while said dispenser means is being rotated so that said material will then be stretched permitting a sufficient amount of said stretched material to be dispensed from said dispenser means to provide a band comprising plural layers of said material around said load.

* * * * *